US007175151B2

(12) United States Patent
Chang

(10) Patent No.: US 7,175,151 B2
(45) Date of Patent: Feb. 13, 2007

(54) HAND TOOL SUSPENSION DEVICE

(76) Inventor: Chi-Tsai Chang, No. 39, Sec. 3, Han Kou Rd., Taichung City (TW)

( * ) Notice: Subject to any disclaimer, the term of this patent is extended or adjusted under 35 U.S.C. 154(b) by 46 days.

(21) Appl. No.: 11/085,212

(22) Filed: Mar. 22, 2005

(65) Prior Publication Data

US 2006/0214083 A1 Sep. 28, 2006

(51) Int. Cl.
*A47G 29/00* (2006.01)

(52) U.S. Cl. ..... 248/689; 206/349; 206/807; 248/551

(58) Field of Classification Search ..... 248/689, 248/551, 309.1, 314, 316.1, 316.8; 211/70.6; 206/689, 807, 375, 495
See application file for complete search history.

(56) References Cited

U.S. PATENT DOCUMENTS 5,484,056 A * 1/1996 Wood ..... 206/349
6,637,591 B2 * 10/2003 Chen ..... 206/349
2003/0029756 A1 * 2/2003 Vasudeva et al. ..... 206/379
2004/0256262 A1 * 12/2004 Wheeler et al. ..... 206/349
2005/0126943 A1 * 6/2005 Liu ..... 206/378

* cited by examiner

*Primary Examiner*—Ramon O Ramirez
(74) *Attorney, Agent, or Firm*—Leong C. Lei

(57) ABSTRACT

An anti-theft suspension device for screwdrivers or the alike is provided. The suspension device has a clamping member at the bottom of a suspension board. The clamping member has a hollow body with a tilted fixing plate installed inside. Both the hollow body and the fixing plate have openings allowing the tool to be inserted through. The tilted fixing plate is arranged so that the axis of its opening is not aligned with those of the clamping member's openings. When the tool is inserted through the openings, the friction between the tool and the fixing plate causes the axis of the fixing plate's opening to align with the openings of the clamping member and the tool thereby could be inserted easily. When the tool reaches its destination, a restoring force takes the fixing plate back to its original, tilted position and the tool is affixed to the fixing plate.

4 Claims, 5 Drawing Sheets

HAND TOOL SUSPENSION DEVICE

BACKGROUND OF THE INVENTION (a) Technical Field of the Invention

The present invention generally relates to suspension devices, and more specifically to a suspension device for a hand tool such as screwdriver.

(b) Description of the Prior Art

Various anti-theft packagings of hand tools for hanging on a display rack have already been disclosed by quite a few patents. However, most of these devices are applicable only to ratchets or two-piece hand tools such as pliers. For one-piece tools such as screwdrivers that have a long rod extended out of a handle, as they are difficult to position and to fix, an adequate packaging is still not available. It is therefore that most of them are still housed completely inside a plastic case, as shown in FIG. 10. This kind of packaging prevents a buyer from physically tryout the tool. It is also difficult for a buyer to judge whether the tool's dimension meets his or her requirement. As such, there is a need for a suitable packaging for screwdrivers or similar hand tools that not only allows a buyer to examine the tools directly but also reduce the risk of theft when they are showcased on a display rack.

SUMMARY OF THE INVENTION

The primary purpose of the present invention is to provide a suspension device that can obviate the shortcomings of conventional packaging for screwdrivers or similar one-piece tools. The suspension device of the present invention has a clamping member at the bottom of a suspension board. The clamping member has a hollow body with a tilted fixing plate installed inside. Both the hollow body and the fixing plate have openings allowing the tool to be inserted through. The tilted fixing plate is arranged so that the axis of its opening is not aligned with those of the clamping member's openings.

The major characteristic of the present invention lies in that, when the tool is inserted through the openings, the friction between the tool and the fixing plate causes the axis of the fixing plate's opening to align with the openings of the clamping member and the tool thereby could be inserted easily. When the tool reaches its destination, a restoring force takes the fixing plate back to its original, tilted position and the tool is fixedly clamped by the fixing plate. Unless the fixing plate is lifted upward to have its opening's axis aligned with the clamping member's openings, the tool could not be removed from the bottom of the clamping member easily.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
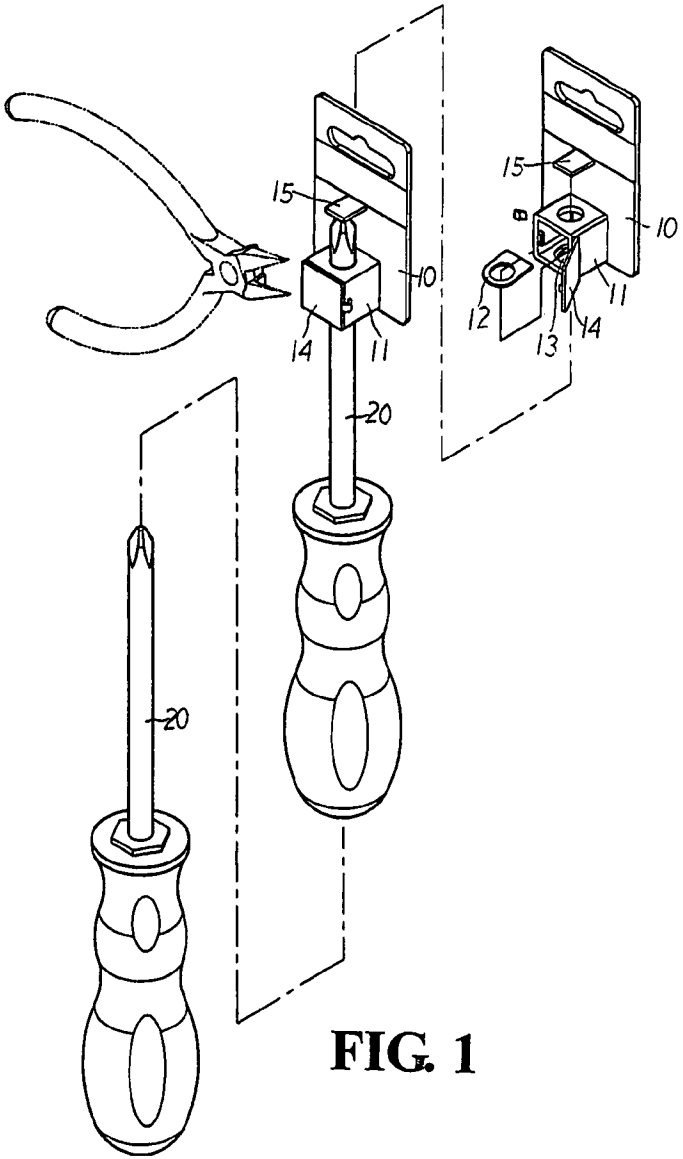
FIG. 1 is a perspective explosion view showing the assembly of a suspension device according to a first embodiment of the present invention.
Figure 2:
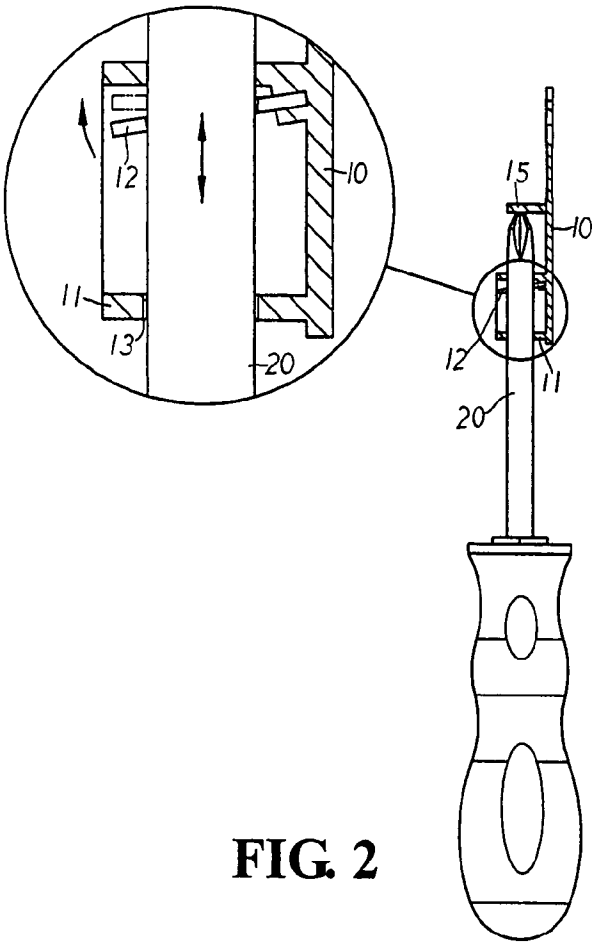
FIG. 2 is a side view showing an assembled suspension device according to a first embodiment of the present invention.
Figure 3:
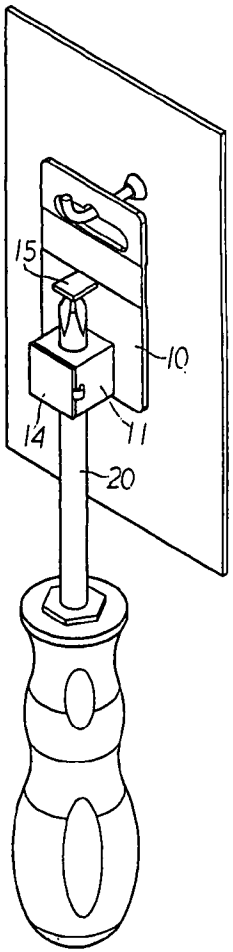
FIG. 3 is a perspective view showing an assembled suspension device according to a first embodiment of the present invention.
Figure 8:
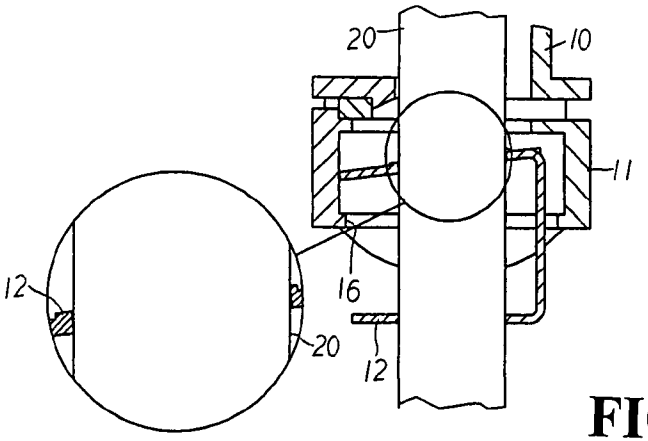
FIG. 8 is an enlarged side view showing a tool hanged in a suspension device according to a second embodiment of the present invention when the clamping member's bottom half is removed.
Figure 9:
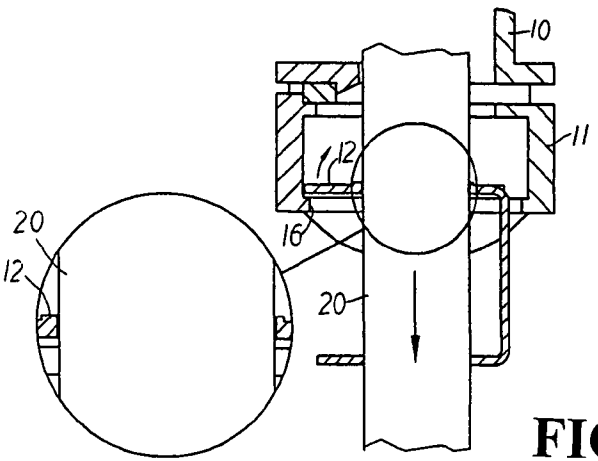
FIG. 9 is an enlarged side view showing a tool removed from a suspension device according to a second embodiment of the present invention when the clamping member's bottom half is removed.
Figure 4:
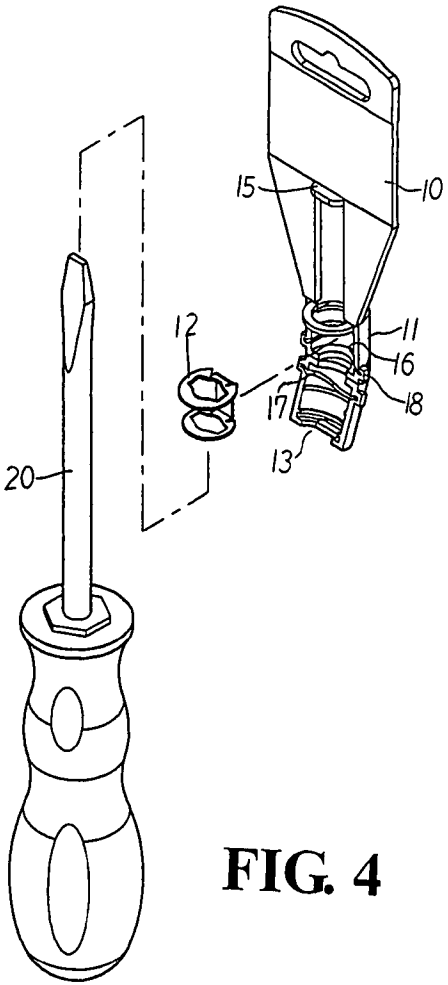
FIG. 4 is a perspective explosion view showing the assembly of a suspension device according to a second embodiment of the present invention.
Figure 5:
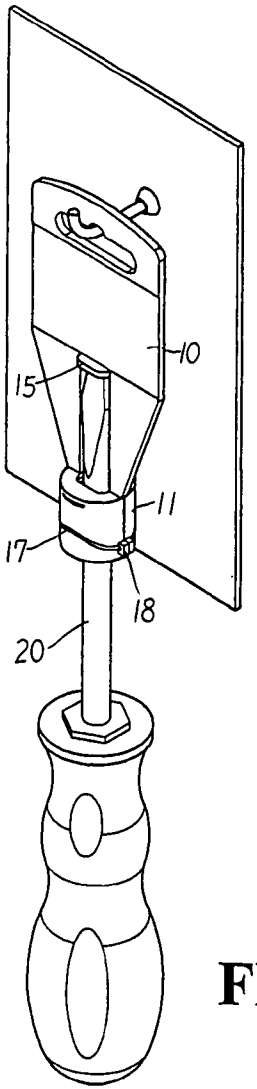
FIG. 5 is a perspective view showing an assembled suspension device according to a second embodiment of the present invention.

With reference to FIGS. 1 to 3, a hand tool suspension device according to a first embodiment of the present invention mainly contains a suspension board 10. The suspension board 10 is of a rectangular shape as illustrated, or the suspension board 10 could have a specially designed form factor (as shown in FIGS. 4 and 5). Whatever the shape is, the suspension board 10 has a clamping member 11 around its bottom edge. The clamping member 11 has a hollow body and two openings 13 at the top and bottom form a vertical through hole allowing the rod of the hand tool 20 to be inserted through. The clamping member 11 could be located on a side of the suspension board 10 as illustrated, or the clamping member 11 could be right beneath the suspension board 10's bottom edge (as shown in FIGS. 4 and 5). For the latter, a shape corresponding to the shape of the rod of the hand tool 20 has to be carved out from the suspension board 10 for the accommodation of the rod of the hand tool 20. Within the clamping member 11, there is a tilted fixing pate 12 that is arranged designedly not to be perpendicular to the suspension board 10. The fixing plate 12 has one of its edges attached to an inner wall of the clamping member 11 that is adjacent to the suspension board 10. The fixing plate 12 then can pivotally move upward and downward around that attached edge. The fixing plate 12 has a corresponding opening (not numbered) such that, together with the openings 13, the rod of the hand tool 20 could be inserted all the way through the clamping member 11 via the openings 13 and the opening of the fixing plate 12. The shape of these openings should match the cross-sectional shape of the rod of the hand tool 20. Please note that, because of the tilted arrangement of the fixing plate 12, when the hand tool 20 is inserted from the bottom opening 13 of the clamping member 11, the upward movement of the rod of the hand tool 20 would appropriately lead the fixing plate 12 upward, causing the axis of the openings to be aligned and the hand tool 20 could thereby be inserted easily. After the hand tool 20 is forced to pass through the clamping member 11 for a distance until it is stopped by the stopping plate 15 and is then released, a restoring force of the fixing plate 12 takes the fixing plate 12 back to its original tilted position, which would stop the hand tool 20 from dropping or pulling out of the clamping member 11. The clamping member 11 is sealed by the cover 14. Unless the cover 14 is destroyed and the fixing plate 12 is lifted upward, there is no way to take the hand tool 20 out of the clamping member 11. As the stopping pate 15 defines a standard distance about how much a hand tool 20 should be inserted through the clamping member 11, a number of hand tools 20 using the suspension devices of the present invention could be displayed uniformly and neatly on a display rack.

The reason that the fixing plate 12 could clamp the hand tool 20 is due to that the axis of the fixing plate 12's opening is not aligned with those of the openings 13. However, the rod of the hand tool 20 is usually a round one with a very smooth surface from electroplating, the hand tool 20 could break out of the constraint of fixing plate 12 by twisting the hand tool 20 back and forth, posing a potential risk of theft. Therefore, in a second embodiment as illustrated in FIGS. 4 and 5, the fixing plate 12 could be designed to rotate synchronously with the hand tool 20. As shown, the present embodiment has two fixing plates 12 attached together into a U-shape. The clamping member 11 is formed by two symmetrical pieces pin-joined together. When the two pieces are closed together, a ring 16 inside around the bottom of a top half of the clamping member 11 separates the hollow interior of the clamping member 11 into two compartments, each of which holds a fixing plate 12. The two pieces themselves have a top and a bottom sections separated by a groove 17 in the middle and connected only by a contact point 18 respectively. When the two pieces are closed together, the lower compartment of the clamping member 11 could be revealed by cutting open the contact point 18 to remove the bottom sections. Please note that the top fixing plate 12 is tilted and provides the same clamping effect as in the previous embodiment. The bottom fixing plate 12 has its opening aligned with the openings 13 and, when the tool 20 is rotated, the fixing plates 12 would rotate synchronously. Therefore, even though the rod of the tool 20 has a smooth surface, it is difficult to break away from the top fixing plate 12's clamping and the risk of theft is reduced.

Figure 6:
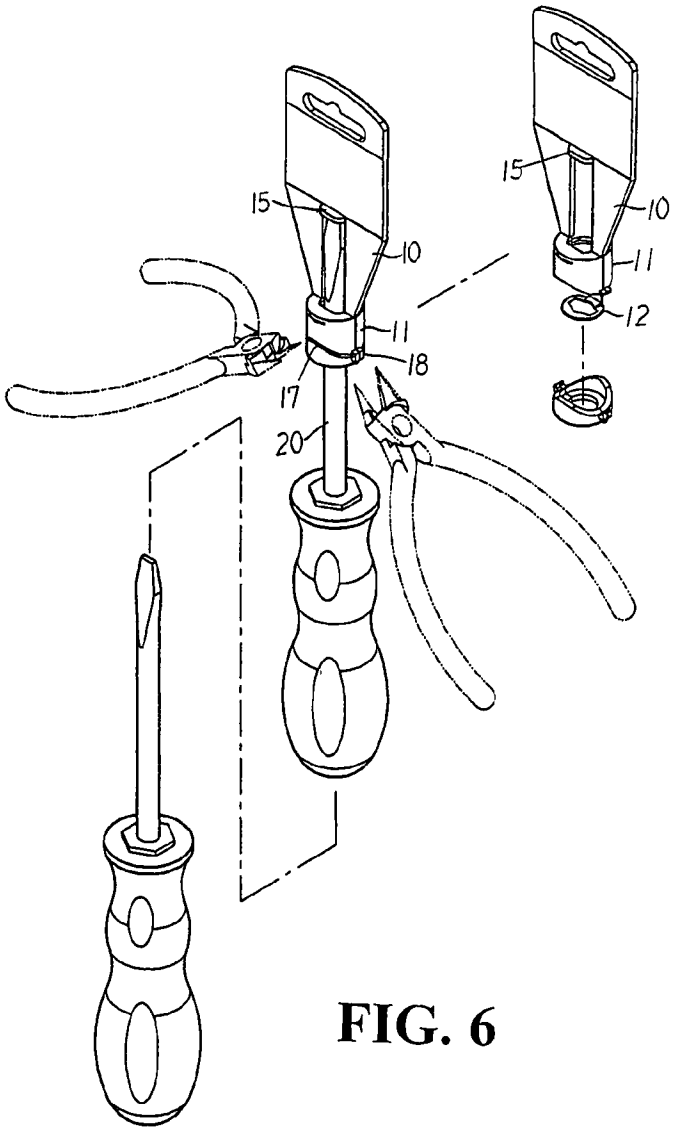
FIG. 6 is a perspective explosion view showing the disassembly of a suspension device according to a second embodiment of the present invention.
Figure 7:
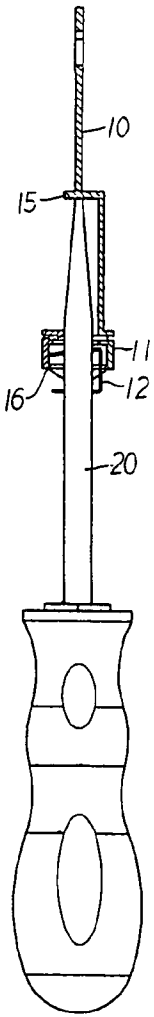
FIG. 7 is a side view showing a suspension device according to a second embodiment of the present invention when the clamping member's bottom half is removed.
Figure 10:
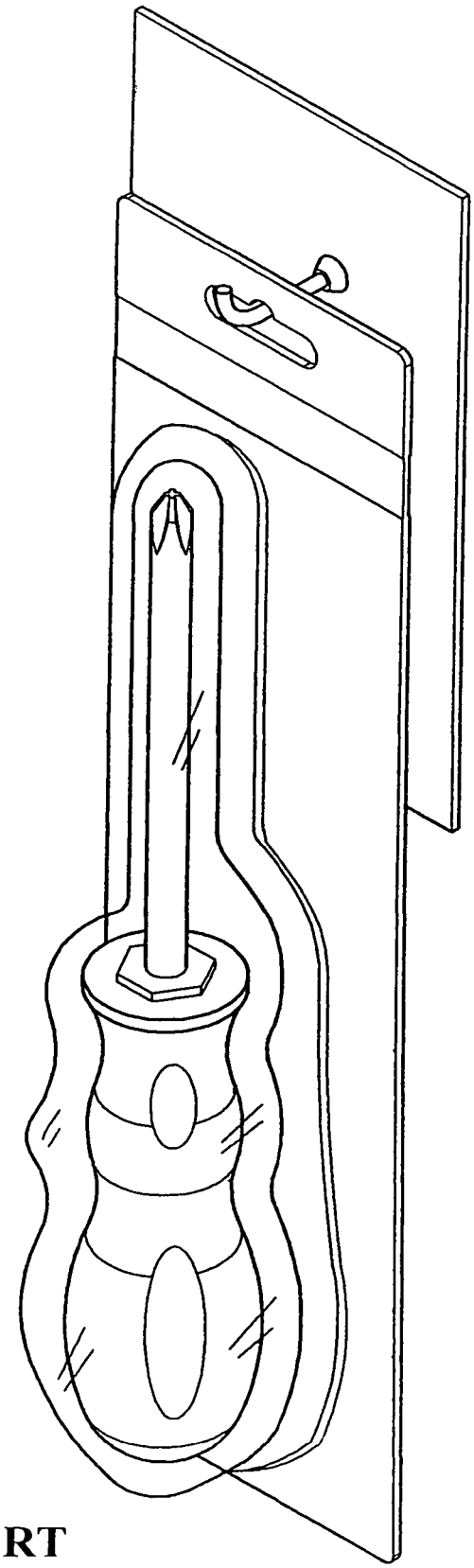
PRIOR ART FIG. 10
FIG. 10 is a perspective view showing a conventional packaging of a hand tool.

To remove the tool 20, as illustrated in FIGS. 6 and 7, a user cut open the contact points 18 so that the bottom half of the clamping member 11 is detached and the bottom fixing plate 12 is exposed. When the user pulls the tool 20, the top fixing plate 12 would be dragged downward and stopped by the ring 16. The originally tilted top fixing plate 12 become flat and the axis of its opening is now aligned with the other openings. The tool 20 thereby could be easily removed from the bottom of the clamping member 11.

In summary, the present invention has a hollow clamping member at the bottom of the suspension board with a tilted fixing plate inside to clamp the tool from falling or pulling down from the bottom. The tool could also be easily removed by cutting open the clamping member. The suspension device according to the present invention indeed provides an effective and anti-theft packaging for the screwdrivers or tools alike.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hand tool suspension device comprising a suspension board and a hollow clamping member at the bottom of said suspension board, said hand tool suspension device characterized in that a tilted fixing plate is installed inside said clamping member, the axis of an central opening of said fixing plate is not aligned with those of said clamping member's openings, and a tool inserted through said openings from the bottom are clamped by said fixing plate from falling or pulling down from the bottom of said clamping member, wherein said central opening of said fixing plate has a shape conforming to the cross-sectional shape of the rod of said tool, and said fixing plate is arranged in a U-shape.

2. The hand tool suspension device according to claim 1, wherein said clamping member is formed by two symmetrical pieces joined together.

3. The hand tool suspension device according to claim 2, wherein each of said symmetrical pieces is separated in a middle by a groove into two sections and said two sections are joined by a contact point.

4. The hand tool suspension device according to claim 3, wherein said symmetrical pieces, when closed together, have a ring inside around the bottom of a top half of said clamping member.

* * * * *